US007263921B2

(12) United States Patent
Grenier et al.

(10) Patent No.: US 7,263,921 B2
(45) Date of Patent: Sep. 4, 2007

(54) AIR DISTRIBUTION ASSEMBLY AND ROTARY CUTTING APPARATUS PROVIDED WITH SUCH AN AIR DISTRIBUTION ASSEMBLY

(75) Inventors: Gilbert Grenier, Annonay (FR); Lilian Monteil, Saint Martin d'Aout (FR)

(73) Assignee: Sandvik Intellectual Property AB, Sandviken (SE)

( * ) Notice: Subject to any disclaimer, the term of this patent is extended or adjusted under 35 U.S.C. 154(b) by 65 days.

(21) Appl. No.: 11/166,215

(22) Filed: Jun. 27, 2005

(65) Prior Publication Data

US 2006/0065088 A1 Mar. 30, 2006

(30) Foreign Application Priority Data

Jul. 2, 2004 (SE) ..... 0401734
Nov. 3, 2004 (SE) ..... 0402666

(51) Int. Cl.
*B26D 7/26* (2006.01)

(52) U.S. Cl. ..... 83/100; 83/152; 83/331; 83/911

(58) Field of Classification Search ..... 83/98, 83/100, 911, 331, 346, 343, 152, 113, 137
See application file for complete search history.

(56) References Cited

U.S. PATENT DOCUMENTS

| | | | | |
|---|---|---|---|---|
| 3,172,321 | A * | 3/1965 | Schrader | 83/100 |
| 3,274,871 | A | 9/1966 | Ehlscheid | |
| 4,671,152 | A * | 6/1987 | Blumle | 83/152 |
| 4,770,078 | A | 9/1988 | Gautier | |
| 5,419,224 | A * | 5/1995 | Gamperling et al. | 83/100 |
| 5,782,156 | A * | 7/1998 | Collins | 83/331 |
| 6,076,444 | A | 6/2000 | Okonski | |
| 6,371,902 | B1 | 4/2002 | Bluemle | |

FOREIGN PATENT DOCUMENTS

| | | |
|---|---|---|
| DE | 87 15 419 | 3/1989 |
| DE | 42 29 699 | 3/1994 |

* cited by examiner

*Primary Examiner*—Stephen Choi
(74) *Attorney, Agent, or Firm*—Drinker Biddle & Reath LLP

(57) ABSTRACT

A rotary cutter includes a hollow rotary mantle having a cutter arbor on an outer periphery thereof, through holes extending radially through the mantle, and an air distribution mechanism. The air distribution mechanism includes first and second parts. The first part is affixed to the mantle coaxially therein for rotation therewith. The second part is arranged inside the first part, wherein the first distribution part is rotatable relative to the second distribution part. The first and second air distribution parts define air passages for communicating selective ones of the through-holes of the mantle with an air source in response to relative rotation between the first and second distribution parts.

19 Claims, 13 Drawing Sheets

AIR DISTRIBUTION ASSEMBLY AND ROTARY CUTTING APPARATUS PROVIDED WITH SUCH AN AIR DISTRIBUTION ASSEMBLY

The present application claims priority under 35 U.S.C. § 119 to Patent Application Ser. No. 0402666-2 filed on Nov. 3, 2004 and Patent Application Ser. No. 0401734-9 filed on Jul. 2, 2004 in Sweden, respectively.

TECHNICAL BACKGROUND OF THE INVENTION

The present invention relates to an air distribution assembly for a rotary cutting apparatus having a shaft and a mantle, the mantle having at least one cutting member.

The invention also relates to a rotary cutting apparatus provided with such an air distribution assembly.

Air distribution in a rotary cutting apparatus is previously known and is performed by radial bores formed in the circumferential surface of a solid rotary cutter. Axial bores connect the radial bores with sources of vacuum and/or atmospheric pressure or over-pressure. Drilling of such axial and radial bores is time consuming and expensive, in particular since they have to be made with high accuracy.

U.S. Pat. No. 4,770,078 discloses in a discussion of the prior art (FIGS. 1-3) a one piece rotary cutter, which has to be removed from the frame when maintenance is needed. In order to allow the machine to be used during maintenance, a further rotary cutter including its static shaft must always be accessible.

In order to overcome that problem, U.S. Pat. No. 4,770,078 suggests to divide the rotary cutter into a rotatable shaft and a mantle. The mantle is connected to the rotatable shaft by means of pneumatic pressure. A drawback with this kind of rotary cutter is that it is difficult to index the rotary cutter relative to the anvil. Another drawback is the lack of support of the rotary cutter on the side opposite to the driven side.

SUMMARY OF THE INVENTION

An object of the invention is to provide the known rotary cutter with a simplified connection to sources of vacuum and/or atmospheric pressure or over-pressure.

This has been achieved by the air distribution assembly of the initially defined kind, which comprises a first air distribution part adapted to rotate together with said mantle and a second air distribution part adapted to be connected to the center shaft.

Preferably, said first air distribution part is provided with openings adapted to correspond to through holes of said mantle and wherein said second air distribution part is provided with openings adapted to at least intermittently correspond to the openings of said first air distribution part. Hereby is achieved a simplified distribution of air to the exterior of the surface of the rotary cutter.

More particularly, said first air distribution part is provided with at least one first opening adapted to correspond to through holes of the mantle intended to influence a region of the mantle relating to the residues of a cut sheet or the sheet to be cut, and at least one second opening adapted to correspond to through holes of the mantle intended to influence a region of the mantle regarding the cut article or the article to be cut.

Alternatively, only the region comprising the first or the second opening is influenced.

In addition, said second air distribution part is provided with at least one third opening adapted to at least intermittently correspond to said first opening, said third opening being associated with a source of vacuum.

Suitably, said second air distribution part is provided with at least one fourth opening adapted to at least intermittently correspond to said second opening, said fourth opening being associated with a source of vacuum.

Alternatively, said second air distribution part is provided with at least one third opening adapted to at least intermittently correspond to said first opening and/or to said second opening, said third opening being associated with a source of vacuum;

Suitably the radial peripheral surface of the second air distribution part is provided with a groove.

Hereby are achieved different possibilities of controlling the air flow from different through-hole on the surface of the rotary cutter.

Preferably, said second air distribution part is provided with at least one fifth opening for influencing a region of the mantle regarding the region of the mantle regarding the cut article and/or the residue of the cut sheet, said fifth opening being associated with atmospheric pressure or a source of over-pressure.

Suitably, the radial peripheral surface of the second air distribution part is provided with a groove for performing the influence to the region of the mantle regarding the cut article and the residue of the cut sheet.

Hereby are achieved different possibilities of controlling the air flow to different through-hole on the surface of the rotary cutter.

Advantageously, said first air distribution part is adapted to be arranged radially peripheral to that of said second air distribution part.

In particular, said first air distribution part is substantially circular cylindrical and said second air distribution part is substantially circular cylindrical, and wherein said first and second air distribution parts are coaxially arranged in a rotatable interrelationship.

Hereby, a suitable shape of the air distributor parts is achieved.

Preferably, at least one of said shafts is hollow and is associated with a source of vacuum, said second air distribution part being associated with said hollow shaft.

Hereby is achieved a simple and efficient air distribution to the exterior of the rotary cutter.

This has been achieved by a rotary cutter and a rotary cutting apparatus of the initially defined kind, wherein the shaft is adapted to be rigidly mounted in a frame part, and wherein the mantle is rotatably arranged relative to the shaft. Hereby, indexing of the mantle relative to the shaft is made easier, since the mantle can be rotated relative to the static shaft. Furthermore, it is only necessary to perform maintenance of the mantle, i.e. the shaft can be used together with another mantle such that the production can be continued while maintenance is performed on the worn mantle.

Preferably, the mantle is adapted to be connected to a power source for creating a rotational movement of the mantle.

Preferably bearings are provided between the mantle and the shaft. Hereby, a controlled positional and rotational relationship between the static shaft and the mantle is achieved.

Suitably, a power transmission means is provided for transmitting the rotational movement to said mantle.

Advantageously, the mantle has an axial extension and opposite axial ends, wherein said mantle is adapted to be supported by the shaft and connected to the power source in the region of one of the ends of said mantle, and wherein said mantle is adapted to be supported by the shaft in the region of the opposite end.

Alternatively, said shaft is divided into a first and a second shaft member, the mantle having an axial extension and opposite axial ends, wherein said mantle is adapted to be supported by the first shaft member and connected to the power source in the region of one of the ends of said mantle, and wherein said mantle is adapted to be supported by the second shaft member in the region of the opposite end.

Advantageously, the frame part of the rotary cutting apparatus further comprises a fastening means for said shaft and a power transmission connection means for said mantle.

DRAWING SUMMARY

In the following, the invention will be described in greater detail by reference to the accompanying drawings, in which FIG. 1 illustrates a rotary cutting apparatus comprising an anvil and a cross-section of a rotary cutter according to a first embodiment of the invention;

DESCRIPTION OF PREFERRED EMBODIMENTS

Figure 1:
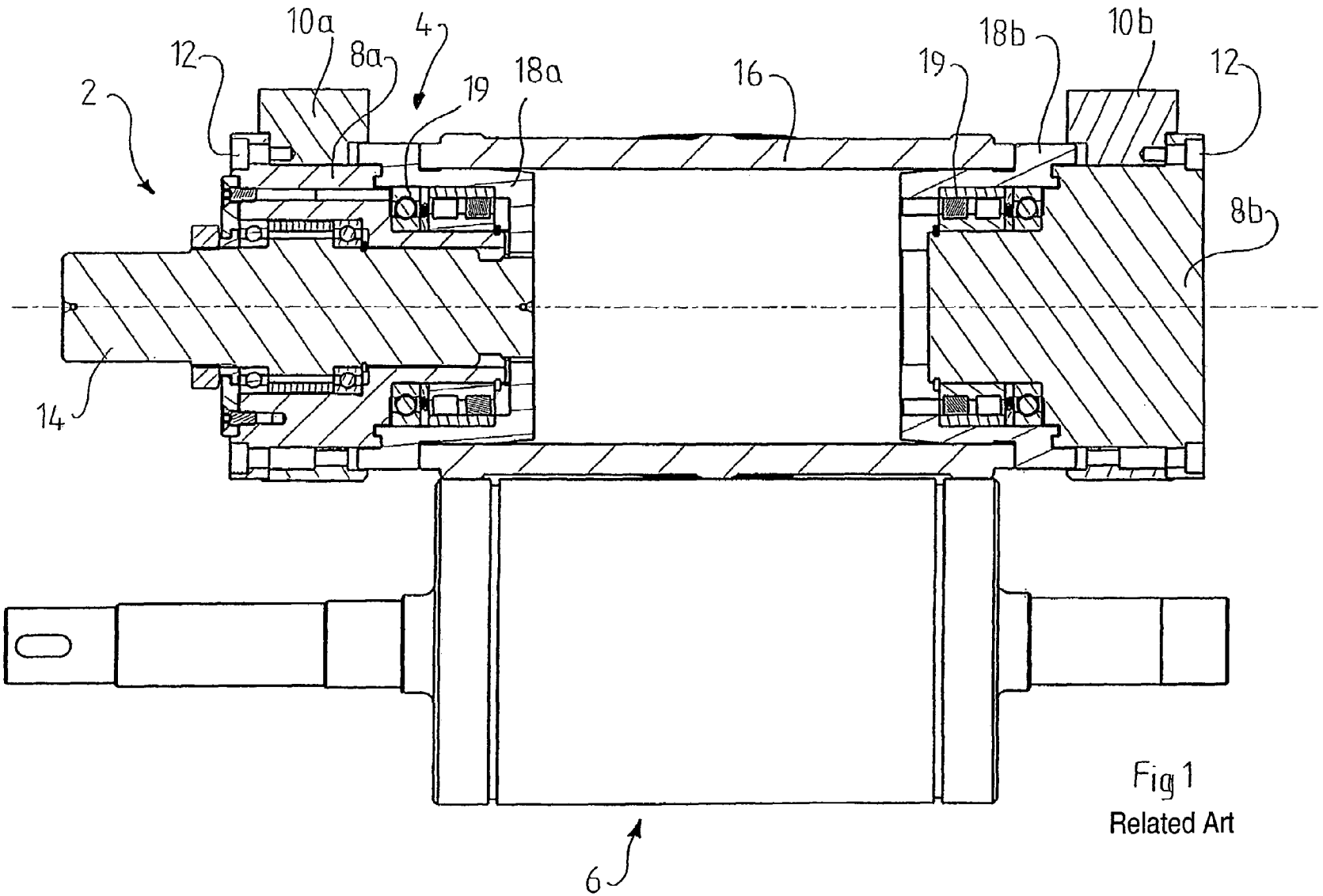
Fig 1 Related Art

FIG. 1 shows a rotary cutting apparatus 2, comprising a rotary cutter 4 and an anvil roll 6. The rotary cutter 4 comprises a divided static (stationary) shaft 8, comprising axially spaced shaft members 8*a*, 8*b*, each member being rigidly connected to a respective frame part 10*a*, 10*b* by means of screws 12. A drive axle 14 is associated with a not-shown power source for transmitting a rotational movement to a tool in the form of a mantle 16 via an intermediate transmission member 18*a*. The rotational movement is further transmitted to a rotational support 18*b*. Cylindrical bearings 19 are provided between the shaft members 8*a*, 8*b* and the intermediate transmission members 18*a*, 18*b*, respectively, for centering the mantle 16 relative to the shaft members 8*a*, 8*b*. The frame parts 10*a*, 10*b* are secured to the rest of the frame by means of suitable, not-shown fastening means. The mantle 16 is provided with at least one cutting member 17 (See FIG. 4A) which is endless so as to be able to cut an article from a sheet.

During disassembly, the frame parts 10*a*, 10*b* are unsecured from the rest of the frame such that the static shaft members 8*a*, 8*b* including the transmission members 18*a*, 18*b* can be pulled out from the mantle 16. The mantle 16 is taken away and maintenance can thus be performed. Another mantle. 16 is mounted in place of the other one, and the rotary cutting device can be utilised without long stoppage.

Of course, it may be enough to take away either of the static shaft members 8*a* and 8*b*, respectively, rather than both.

Figure 2:
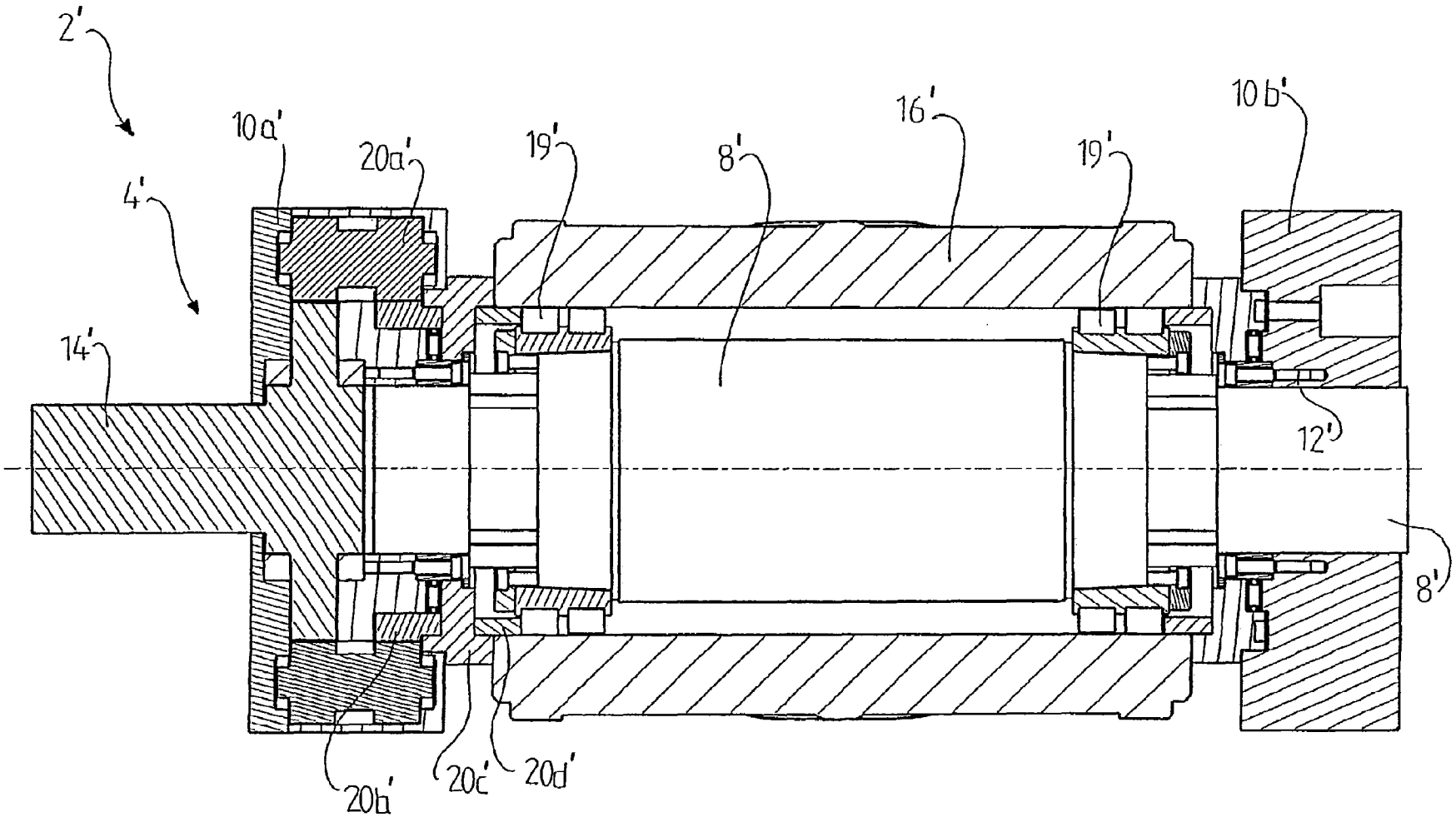
Fig 2 Related Art
FIG. 2 is a cross-section of a second embodiment of the rotary cutter.

FIG. 2 shows a second embodiment of a rotary cutting apparatus 2' and rotary cutter 4'. The cross-section is such that the cutting member 17' has been omitted, but is of course present (see FIG. 4). The static shaft 8' is in this case a single part and is connected to the frame parts 10*a*', 10*b*' on either side of the mantle 16' by screws 12'. The rotational movement of the drive axle 14' is transmitted to the mantle 16' via a gear train 20*a*', 20*b*', 20*c*', 20*d*'. It should be noted that the parts 20*b*', 20*c*', 20*d*' could be produced as two pieces or even one single piece. Centering is performed by means of cylindrical bearings 19'.

Figure 3:
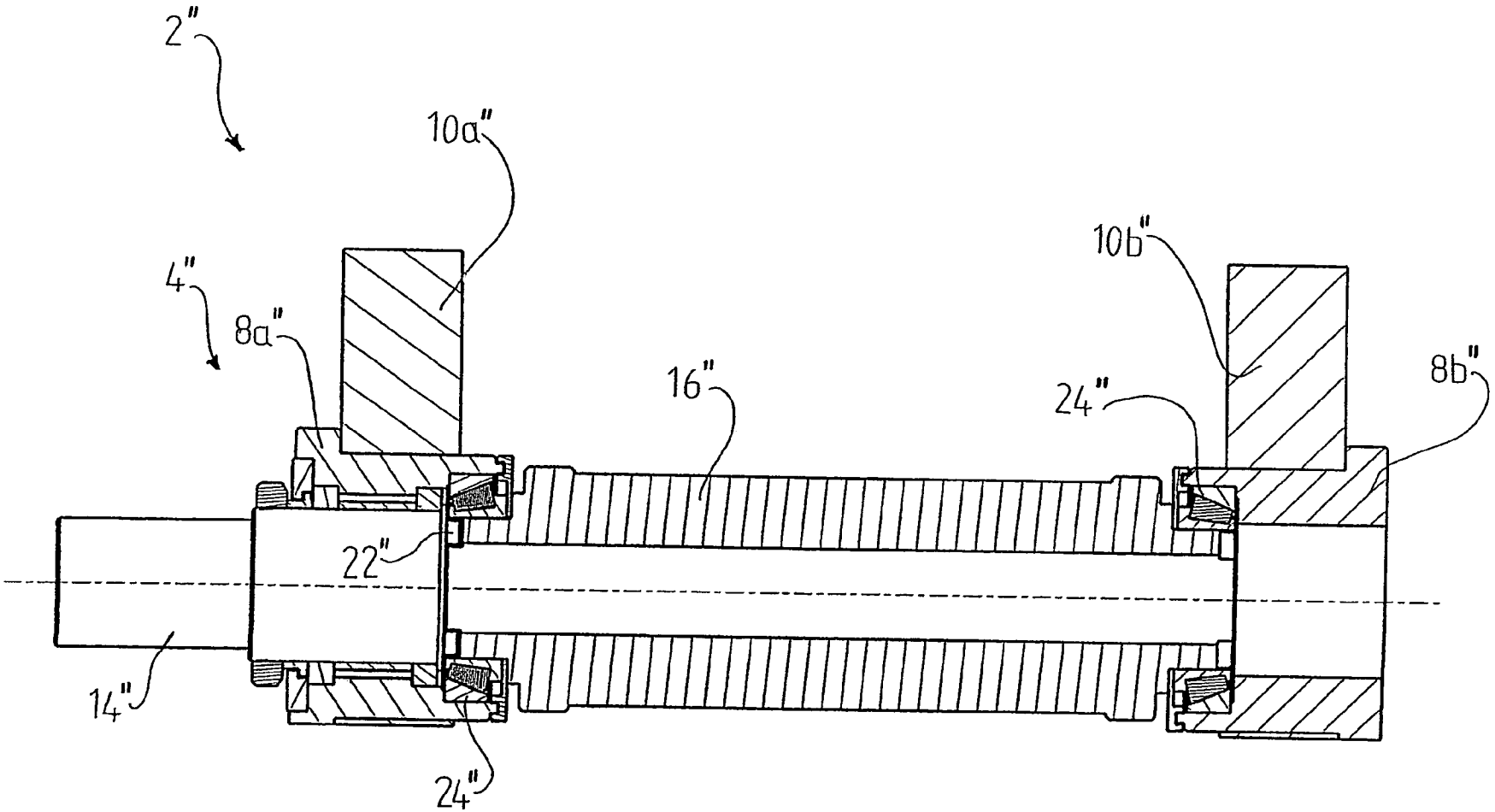
Fig 3 Related Art
FIG. 3 is a cross-section of a third embodiment of the rotary cutter.

FIG. 3 shows a third embodiment of a rotary cutting apparatus 2" and a rotary cutter 4". Also in this case, the cross-section is such that the cutting member has been omitted. The drive axle 14" transmits rotational movement directly to the mantle 16" via a coupling member 22". The static shaft is divided into two shaft members 8*a*", 8*b*" connected to the frame parts 10*a*", 10*b*" on either sides of the mantle 16". The mantle 16" is centered relative to the shaft members 8*a*", 8*b*" and the driving axle 14" by means of conical bearings 24".

For maintenance purposes, the shaft member 8*b*" is unsecured from the frame parts 10*a*", 10*b*", and then the mantle 16" is released from the shaft member 8*a*".

The mantle 16, 16', 16" may be made of a multiphase material, such as steel, cemented carbide or cermet (hard phase bonded by a metal).

Figure 4A:
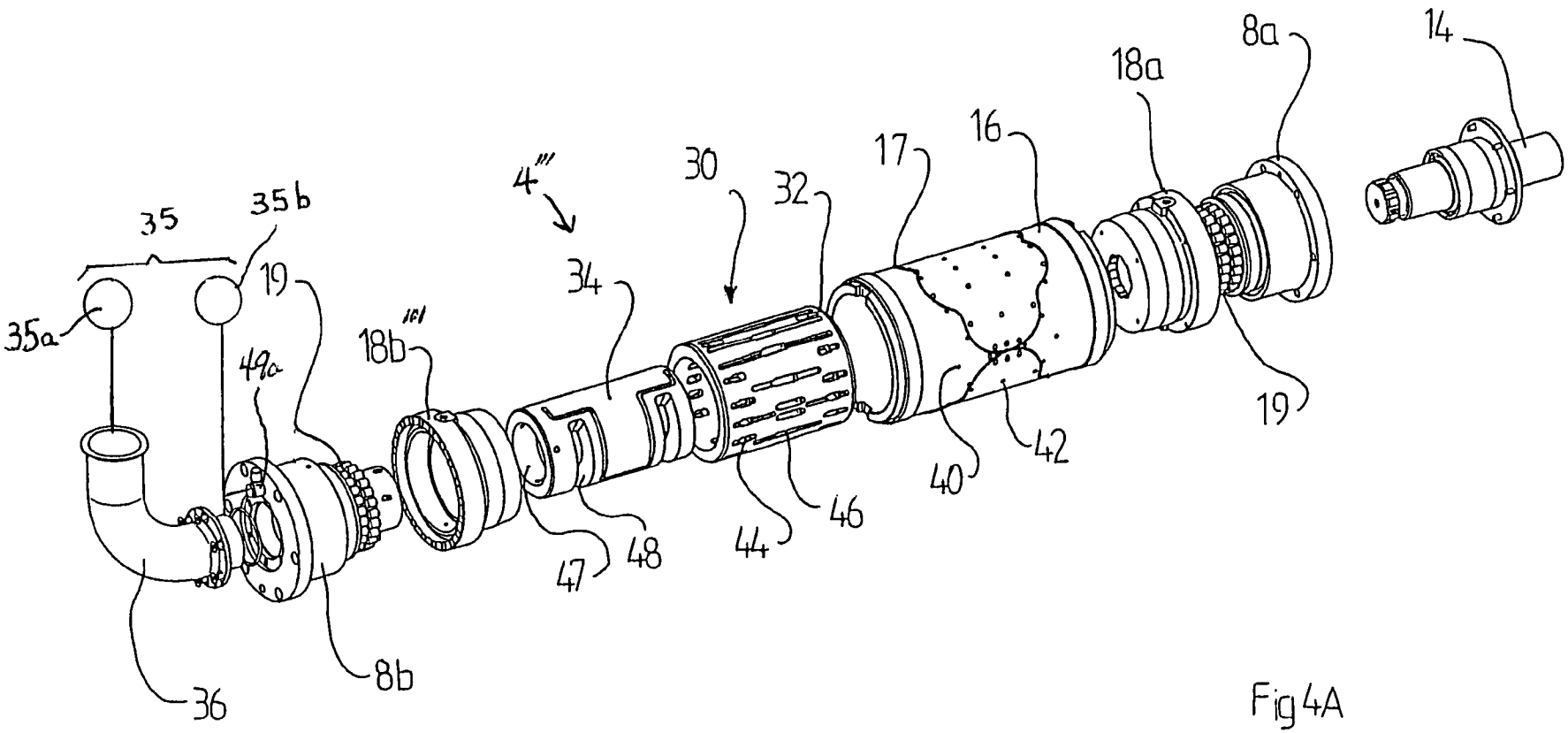
FIGS. 4A and 4B is an exploded view and an axial cross-section of the first embodiment, provided with an air distribution assembly.

FIG. 4A shows a rotary cutting apparatus 2'" and a rotary cutter 4'" similar to the first embodiment (see FIG. 1), so the same reference numerals designating the same elements as in FIG. 1 will be used in FIG. 4A. A major difference between the embodiments of FIGS. 1 and 4A is that in FIG. 4A the rotary cutter 4'" is provided with an air distribution assembly 30 which comprises a first air distribution part 32, a second air distribution part 34, an air connection piece 36 and said shaft member 8*b*'", now hollow, for interconnecting the second air distribution part 34 and said air connection piece 36. The air connection piece 36 is connected to a section of an air source 35, namely to a source of vacuum pressure 35*a* (see FIG. 4A).

The first and second air distribution parts 32, 34 may be made of a polymer, a metal, a hard metal or ceramics. It is however not necessary that the parts 32 and 34 be made of the same material.

As already stated above, cylindrical bearings 19 are provided between the shaft members 8*a*, 8*b*'" and the intermediate transmission members 18*a*, 18*b*, respectively, for centering the mantle 16 relative to the shaft members 8*a*, 8*b*'".

The mantle 16 is connected to the first air distribution part 32 by press-fit, fastening means or gluing, whereas the second air distribution part 34 is connected to the connection piece 36 via shaft member 8*b*'", preferably by a fastening means. Thus, during operation the first air distribution piece 32 rotates together with the mantle 16, whereas the second air distribution piece 34 is static.

The mantle 16 is provided with first through-holes 40 outside the cutting member 17 and second through-holes 42 inside the cutting member 17. The reason for this will be explained further below.

Figure 4B:
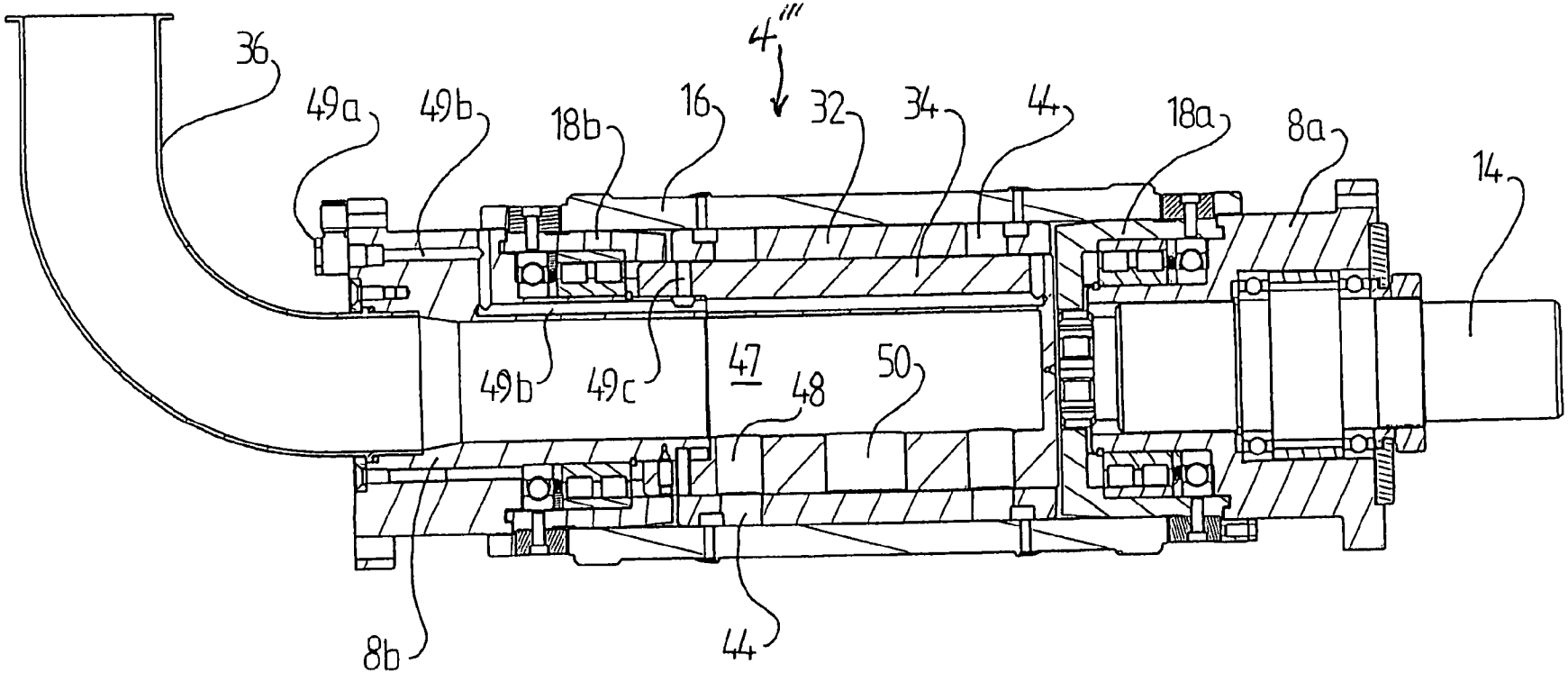

FIG. 4B shows the assembled rotary cutter 4'", the mantle 16 and the first and second distribution parts 32, 34 being coaxially arranged. First and second openings 44 and 46 in the first distribution part are provided for connection to respective through-holes 40, 42 (see FIG. 4A) of the mantle 16. The first and second distribution parts 32, 34 are hollow and substantially circular cylindrical in shape. During operation, the second distribution part 34 defines a coaxial lumen 47 which connects to the interior of the air connection piece 36, which in turn is connected to the source of vacuum pressure 35*a*.

A connector 49*a* is connected to another section of the air source 35, namely a source of pressure 35*b* which is at least at atmospheric pressure 35*b*, i.e., atmospheric pressure or an over-pressure. A bore 49*b* connects the connector 49*a* with a substantially radial bore 49*c* of the second air distribution part.

Figure 5A:
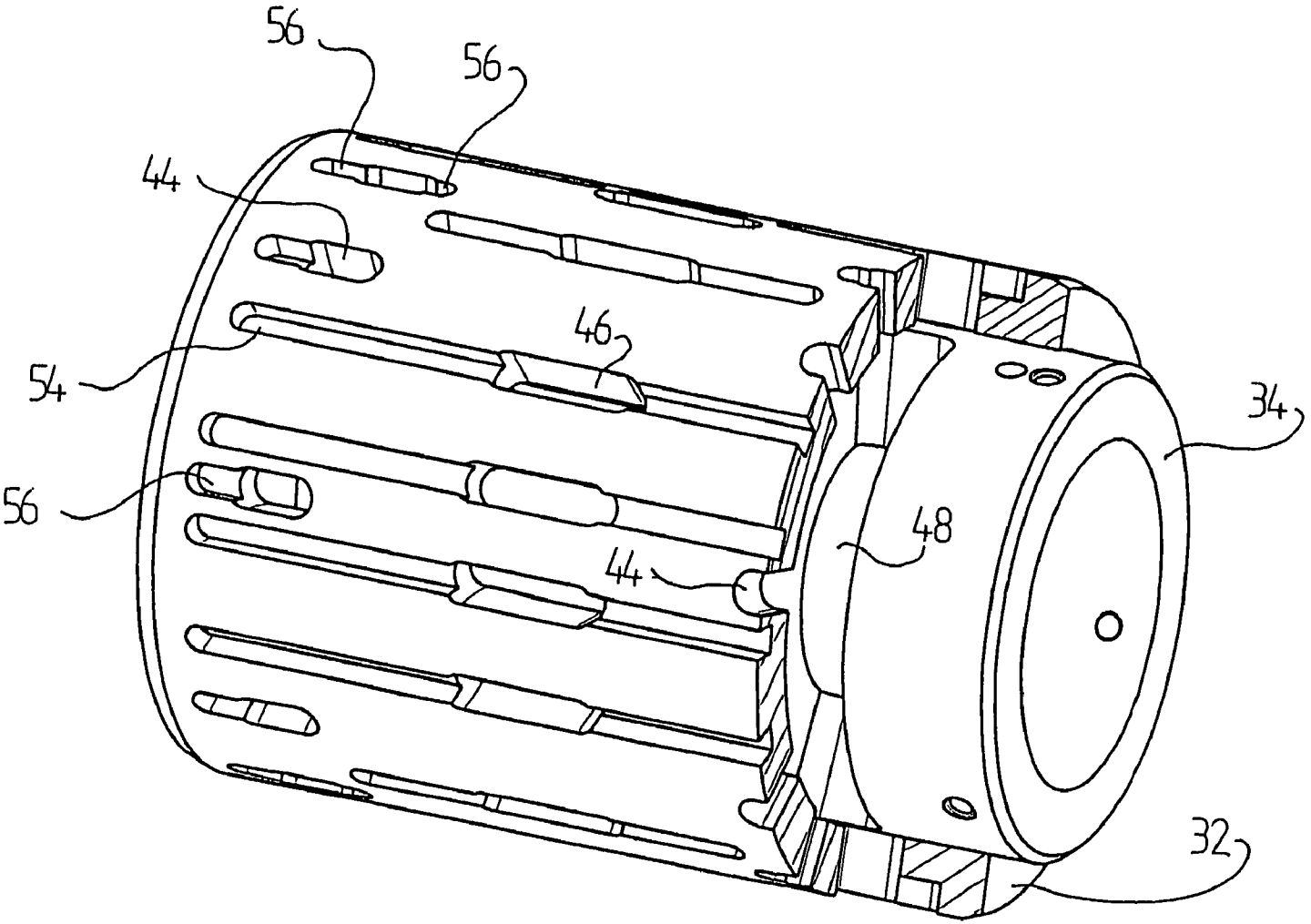
FIGS. 5A and 5B are cross-sections in part of the air distribution assembly shown in FIG. 4B provided with first and a second air distribution parts.

In FIG. 5A, a portion of the first distribution part 32 has been cut away and shows in that relative position of the first and second air distribution parts 32, 34, how the first openings 44 connect to a third opening 48 of the second distribution part 34. The third opening 48 connects in turn to the lumen 47.

Figure 5B:
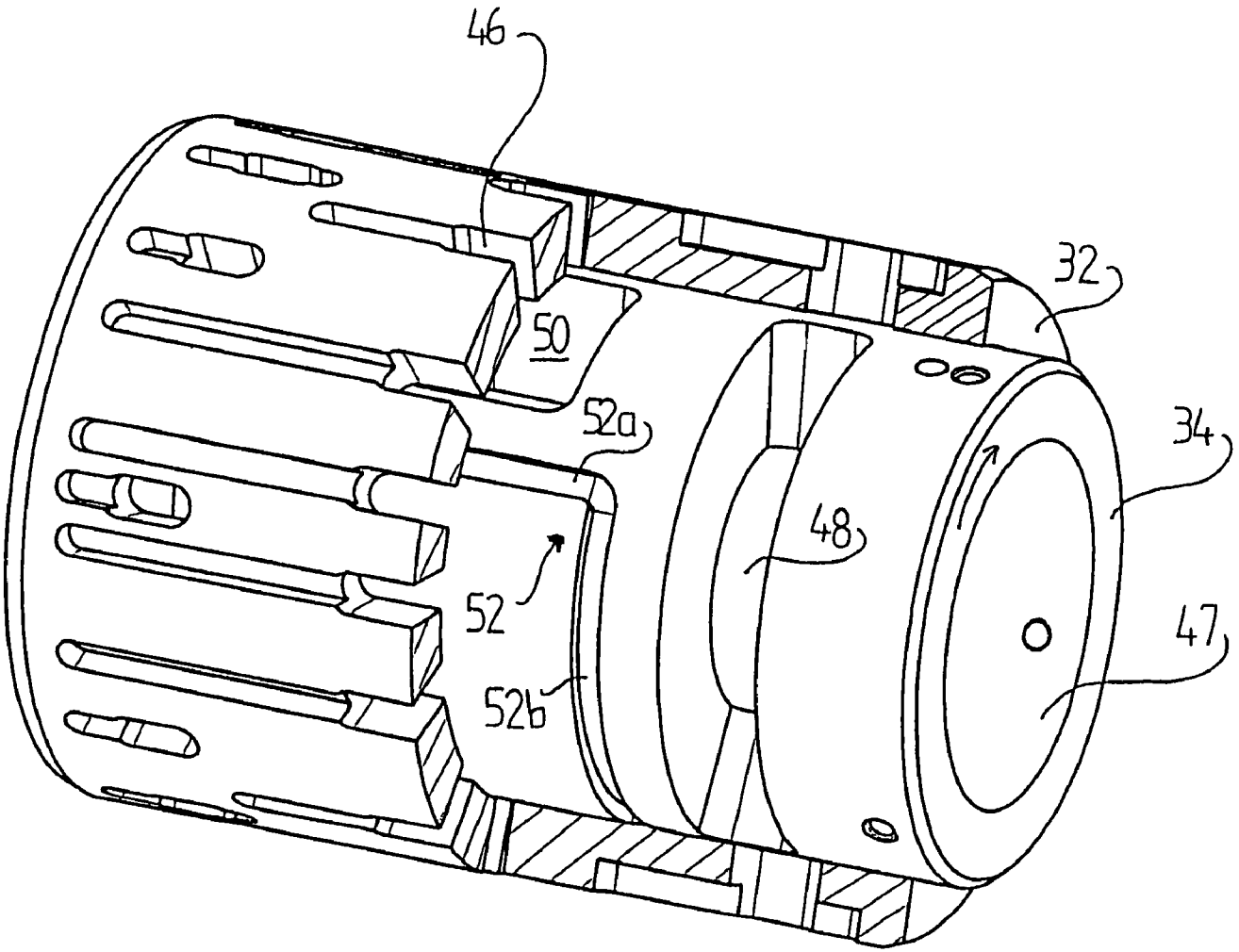

In FIG. 5B, a further portion of the first distribution part 32 has been cut away and shows how the second openings 46 connect to a fourth opening 50 of the second distribution part 34. The fourth opening 50 connects in turn to the lumen 47.

Furthermore, in the rotational direction after the fourth opening 50, a groove 52 is provided in the second distribution part 34. A longitudinal portion 52*a* thereof connects to the second openings 46, whereas a circumferential portion 52*b* continues in the circumferential direction of the second air distribution part 34.

Figure 5C:
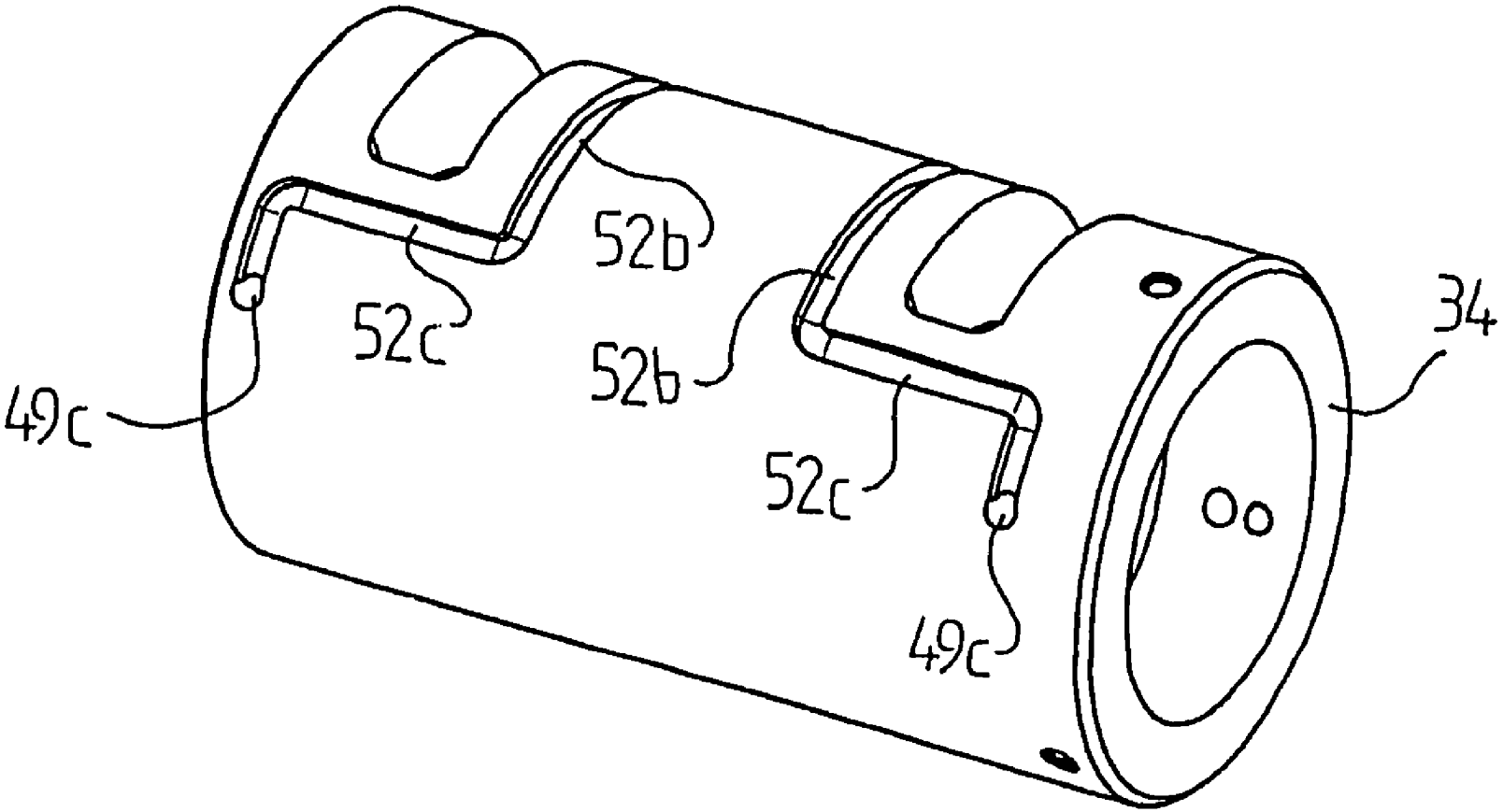
FIG. 5C is a perspective view of the second air distribution part.

As can be seen in FIG. 5C, the circumferential portion 52*b* of the groove 52 continues with a further longitudinal portion 52*c* and continues with a substantially radial bore 49*c*, which in turn is connected to the connector 49*a* via the bore 49*b* (see FIG. 4B).

The size of the second opening 46 is substantially constant in order to fit the size of the fourth opening 50. However, in order to fit the form of the article to be cut, i.e. the shape of the knife member 17, an axial groove 54 is arranged in the surface of first distribution part 32.

In the same manner, the size of the second opening 44 is substantially constant in order to fit the size of the third openings 48, and in order to fit the form of the residue of the sheet, i.e. also in this case the shape of the knife member 17, an axial groove 56 is arranged in the surface of first distribution part 32.

Figure 6A:
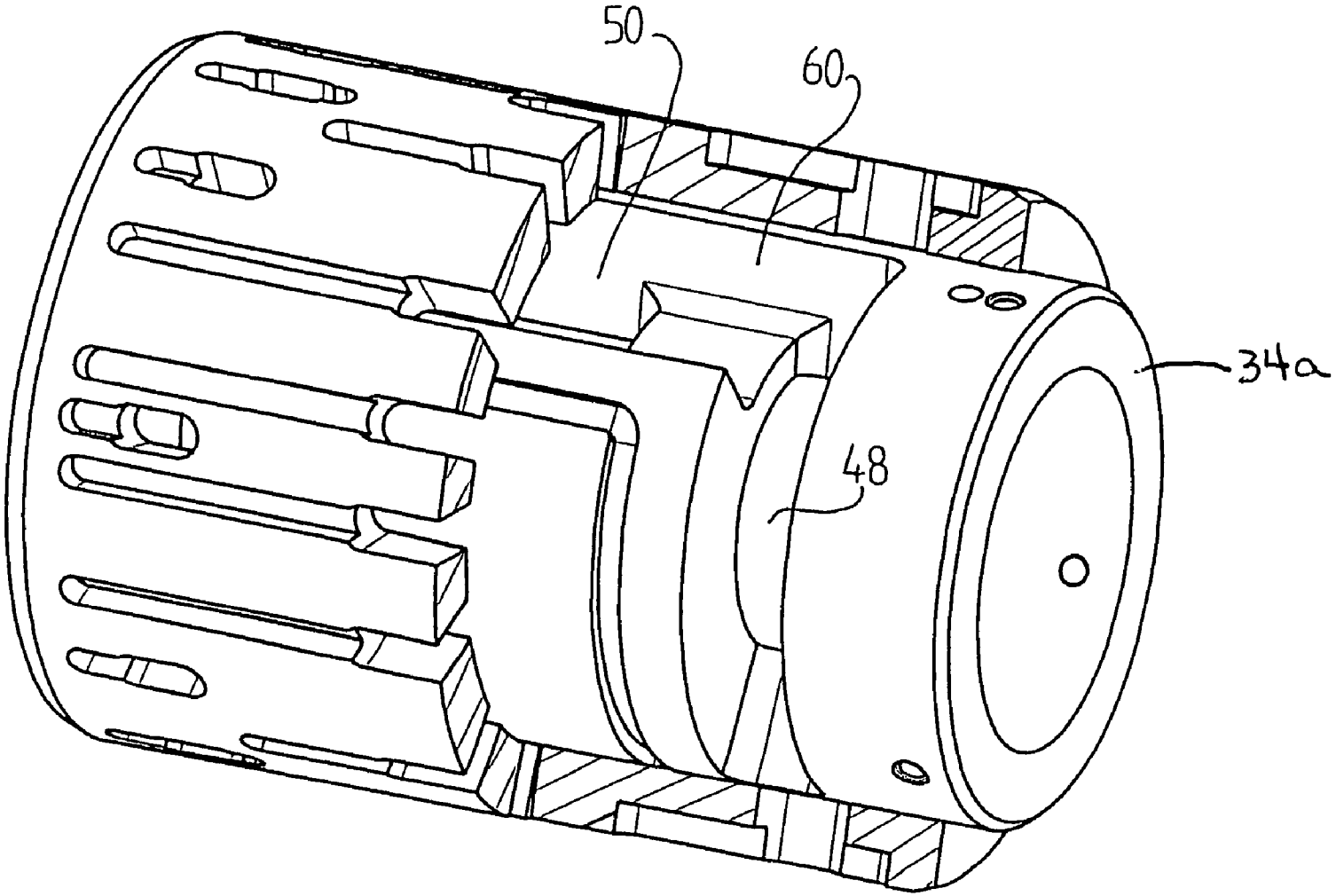
FIGS. 6A and 6B are cross-sections in part of alternative air distribution assemblies.

In FIG. 6A, an alternative embodiment of a second distribution part 34*a* is presented, according to which the third and fourth openings 48, 50 have been interconnected by a longitudinal groove 60.

Figure 6B:
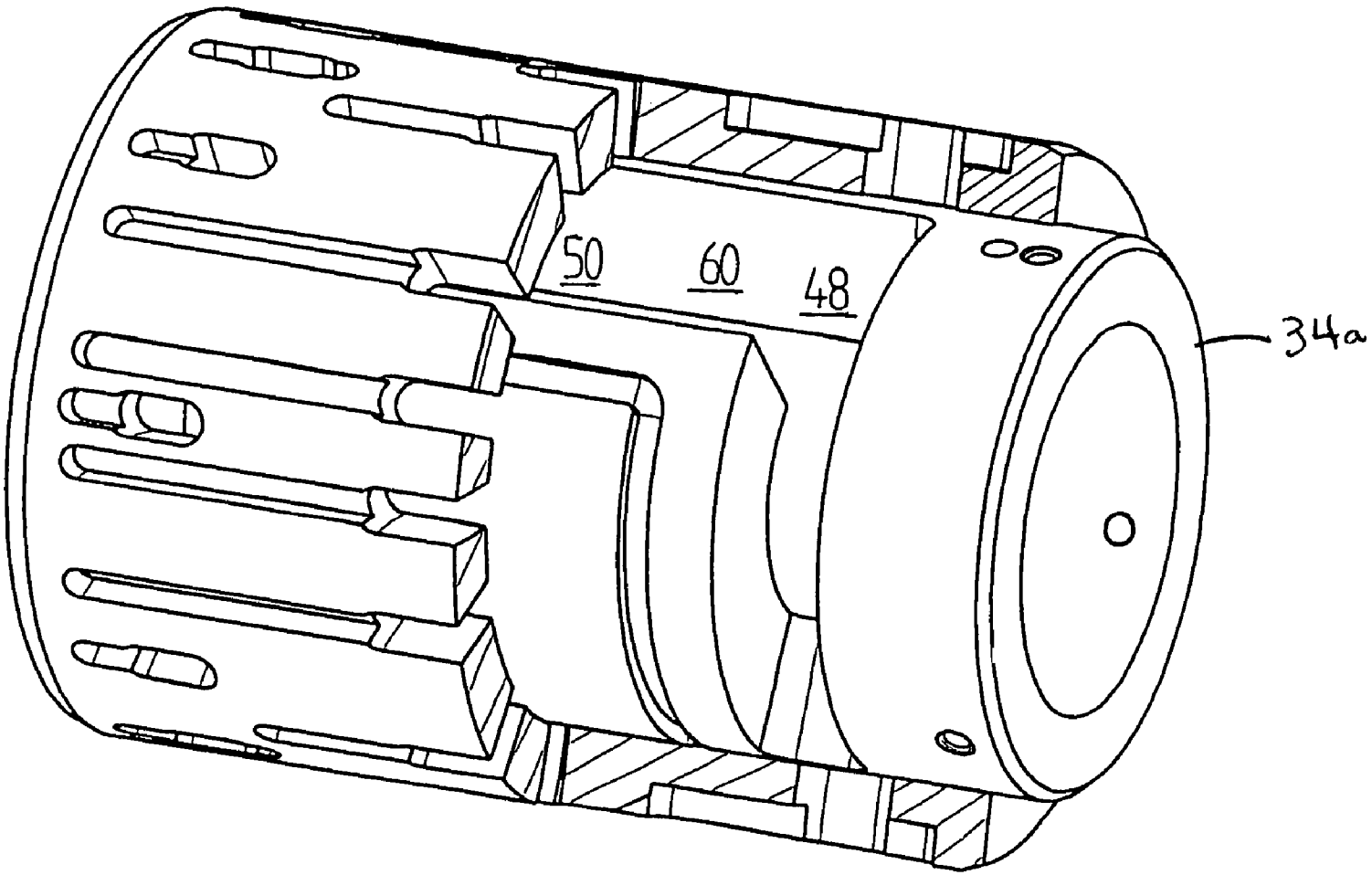

In FIG. 6B, the groove 60 is a radial opening, i.e. it projects radially through the part 34*a*, whereby the openings 48, 50, 60 form a single opening.

Figure 7A:
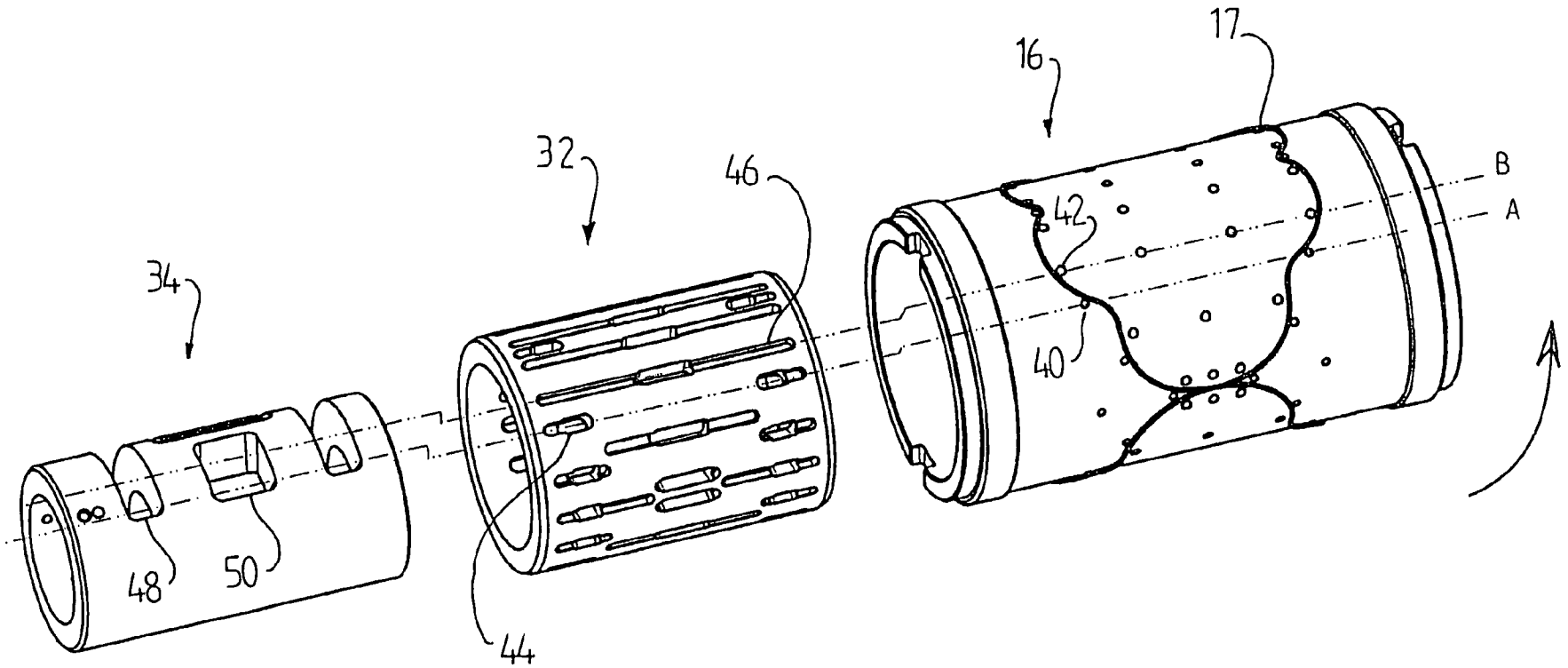
FIGS. 7A and 7C illustrate the air distribution parts and the mantle in different angular positions.
Figure 7B:
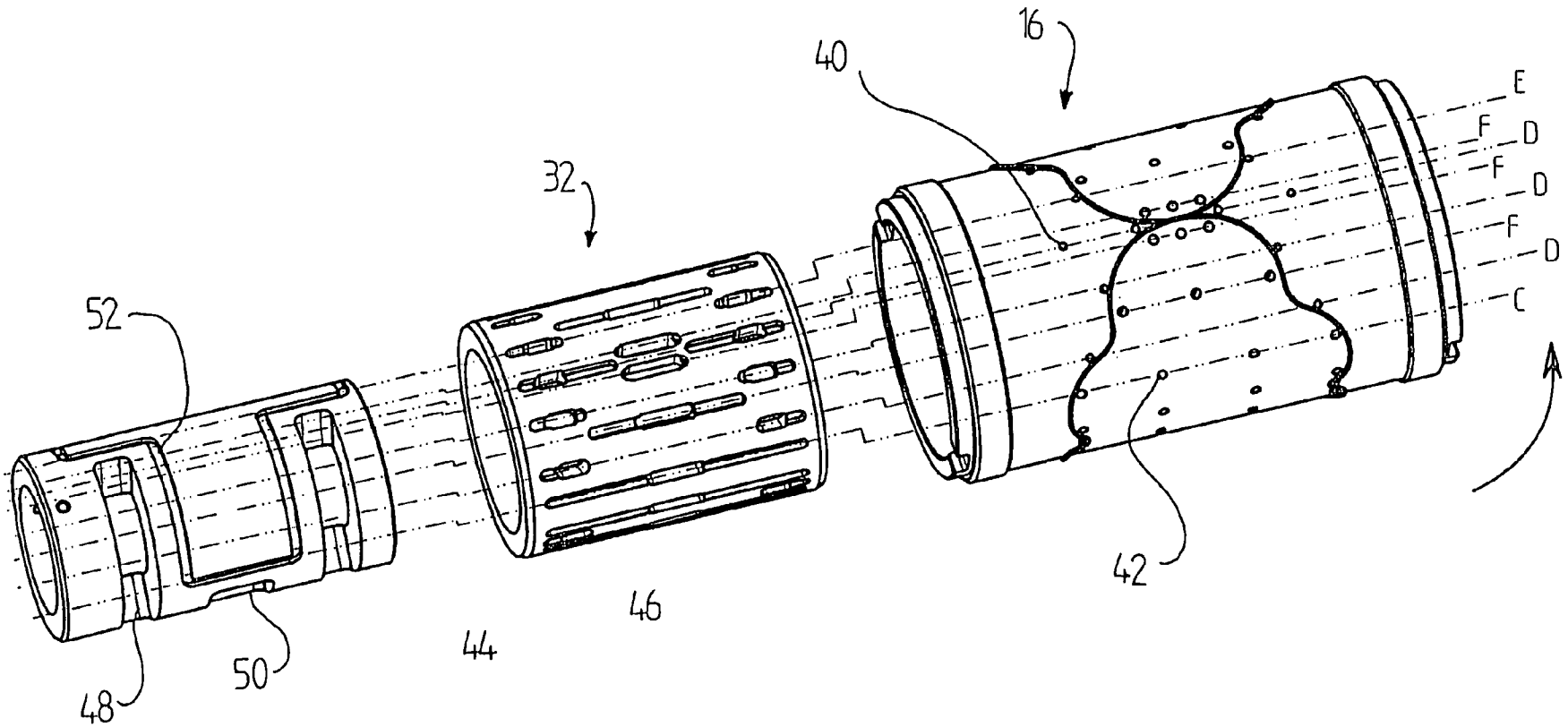
Figure 7C:
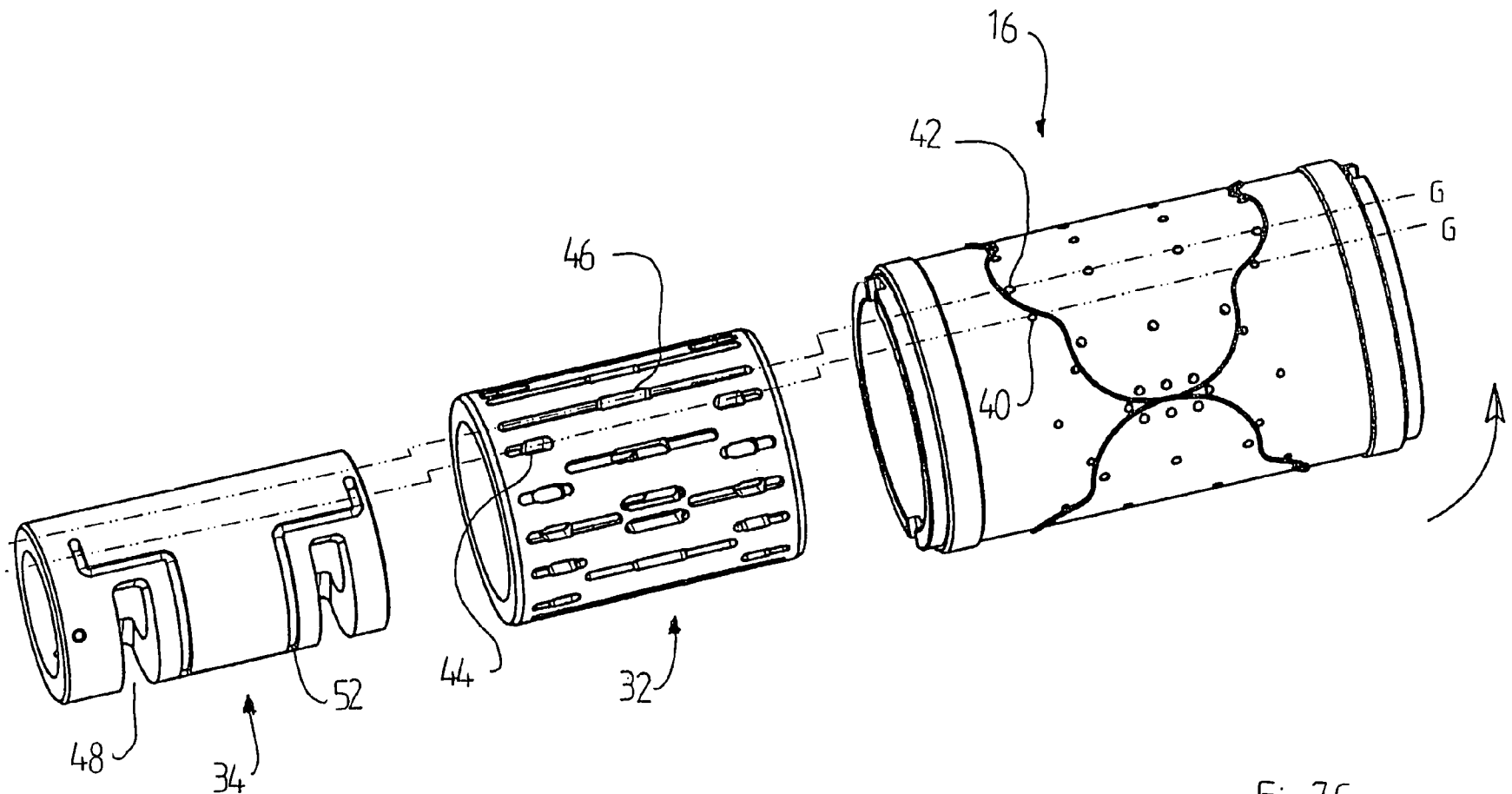

FIGS. 7A-7C illustrate how the openings of the air distribution parts 32, 34 correspond to the through-holes of the mantle 16 in different relative positions.

Consequently, in FIG. 7A broken lines A and B indicate different circumferential positions of the first and second air distribution parts 32, 34 and the mantle 16 of a predetermined angular position of the first and second air distribution parts.

The through-holes 40 outside the knife member 17 are connected to the third openings 48 via the first openings 44 along the line A. Similarly, the through-holes 42 along line B and inside the knife member 17 are connected to the fourth opening 50 via the second openings 46.

Consequently, the through-holes 40 as well as the through-holes 42 will be subjected to a vacuum.

In FIG. 7B is shown that the through-holes 42 along the line C are connected to the groove 52, whereas the through-holes 40 along the lines D are connected to third openings 48.

Thus, the through-holes 40 will remain subjected to a vacuum, whereas the through-holes 42 will be subjected to atmospheric pressure or an over-pressure.

However, at line E, also the through-holes 40 along the line E will also be subjected to atmospheric pressure or an over-pressure.

It should be noted that along lines F, the openings 46 are closed, i.e they do not face an opening or a groove in the second air distribution member 34.

In FIG. 7C is shown that along lines G, the openings 44 as well as the openings 46 are closed.

Thus, during cutting of a sheet, e.g. a web, a cardboard or a metallic foil, and due to vacuum distributed to predetermined through-holes 40 and 42 (see the lines A and B in FIG. 7A), the whole sheet will stick to the surfaces both outside and inside the knife member 17, while the knife-member cuts against the anvil roll 6 (see FIG. 1).

After cutting the article, the mantle 16 and the first air distribution part 32 has rotated away from the contact with the anvil roll 6, and to another position of the second air distribution part 34 (see the lines C in FIG. 7B). The article will come loose from the mantle 16, due to atmospheric pressure or over-pressure distributed to the same predetermined through-holes 42, whereas the rest of the sheet will stick to the mantle 16, due to the vacuum distributed to the same predetermined through-holes 40. A slight further rotation will cause the openings 46 to close (see the lines F in FIG. 7B).

Further rotation of the mantle 16 and the first air distribution part 32 relative to the anvil roll 6 and to the second air distribution part 34 will cause also the rest of the sheet to come loose from the mantle 16, since the same predetermined through-holes 40 will then be subjected to atmospheric pressure or an over-pressure (see line E in FIG. 7B).

A slight further rotation will cause the openings 46 and then the openings 44 to close (see line G in FIG. 7C).

With minor modifications of the rotary cutter shown in FIG. 2, it would also be possible to use the air distribution parts 32, 34 in that embodiment.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A rotary cutter for a rotary cutting apparatus comprising:

a hollow rotary mantle having at least one cutting member on a cylindrical outer periphery thereof, and through-holes extending generally radially through the mantle; and an air distribution mechanism comprising:

a first air distribution part affixed to the mantle coaxially therein for rotation therewith, and a second air distribution part arranged inside said first air distribution part, wherein the first distribution part is rotatable relative to the second distribution part, wherein the first and second air distribution parts define air passages for communicating selective ones of the through-holes of the mantle with an air source in response to relative rotation between the first and second distribution parts.

2. The rotary cutter according to claim 1, wherein the first distribution part includes openings arranged to communicate with the through-holes, the second distribution part including openings arranged to at least intermittently communicate with the openings of the first distribution part.

3. The rotary cutter according to claim 2, wherein the cutting member is endless and adapted to cut an article from a sheet, a first plurality of the through-holes disposed outside of the cutting member, a second plurality of the through-holes disposed inside of the cutting member, wherein the first distribution part includes at least one first opening arranged to communicate with the first plurality of through-holes, and at least one second opening arranged to communicate with the second plurality of through-holes.

4. The rotary cutters according to claim 3, wherein the air source includes a source of vacuum pressure, the second distribution part including an opening structure arranged to at least intermittently communicate the at least one first opening with the source of vacuum pressure.

5. The rotary cutter according to claim 3, wherein the second distribution part includes an opening structure arranged to at least intermittently communicate the at least one first opening and the at least one second opening with the source of vacuum pressure.

6. The rotary cutter according to claim 5, wherein the opening structure comprises a plurality of openings spaced axially apart and arranged to communicate with axially spaced ones of the first openings, and a separate opening disposed axially between the axially spaced openings for communicating with the at least one second opening.

7. The rotary cutter according to claim 5, wherein the opening structure comprises a plurality of openings spaced axially apart and arranged to communicate with axially spaced ones of the first openings, and a groove extending generally axially along the outer periphery of the second distribution part and connected to at least one of the axially spaced openings, the groove arranged to communicate with the at least one second opening.

8. The rotary cutter according to claim 5, wherein the air source further includes a source of at least atmospheric pressure; the second distribution part further including another opening structure arranged to at least intermittently communicate the at least one first opening with the source of at least atmospheric pressure.

9. The rotary cutter according to claim 8, wherein the opening structure comprises a plurality of openings spaced axially apart and arranged to communicate with axially spaced ones of the first openings, and a groove extending generally axially along the outer periphery of the second distribution part and connected to at least one of the axially spaced openings, the groove arranged to communicate with the at least one second opening.

10. The rotary cutter according to claim 5, wherein the second distribution part further includes an opening structure arranged to at least intermittently communicate the at least one first opening and the at least one second opening with the source of at least atmospheric pressure.

11. The rotary cutter assembly according to claim 3, wherein the air source comprises a source of vacuum pressure, the second distribution part including an opening structure arranged to:

communicate the at least one first opening and the at least one second opening with the source of vacuum pressure during one portion of each revolution of the first distribution part, and communicate the at least one first opening with the source of vacuum pressure during another portion of each revolution of the first distribution part, while the at least one second opening is isolated from the source of vacuum pressure.

12. The rotary cutter assembly according to claim 3, wherein the air source comprises a source of vacuum pressure and a source of at least atmospheric pressure, the second distribution part including an opening structure arranged to:

communicate the at least one first opening and the at least one second opening simultaneously with the source of vacuum pressure during one portion of each revolution of the first distribution part, communicate the at least one first opening with the source of vacuum pressure and communicate the at least one second opening with the source of at least atmospheric pressure, during another portion of the revolution, and communicating the at least one first opening and the at least one second opening simultaneously with the source of at least atmospheric pressure, during another portion of the revolution.

13. The rotary cutter according to claim 1, wherein the first and second distribution parts are of circular cylindrical shape, the second distribution part being stationary and disposed coaxially within the first distribution part.

14. The rotary cutter according to claim 13, further including a pair of axially spaced stationary shaft portions, one of the shaft portions being hollow and communicating with source of negative pressure of the air source, the second distribution part being mounted to the shaft.

15. The rotary cutter according to claim 1, further including a rotary drive mechanism operably connected to the mantle for rotating the mantle.

16. The rotary cutter according to claim 1, further including a stationary shaft structure on which the mantle and the first and second distribution parts are mounted, and bearings disposed between the mantle and the shaft structure.

17. The rotary cutter according to claim 16, further including a rotary drive mechanism operably connected to the mantle for rotation the mantle.

18. The rotary cutter according to claim 1, further including first and second axially spaced shaft portions disposed in opposite respective axial ends of the mantle of supporting the mantle, and a rotary drive mechanism operably connected to one axial end of the mantle for rotating the mantle.

19. A rotary cutting apparatus comprising:

a rotary anvil; and a rotary cutter disposed opposite the anvil and including a hollow rotary mantle having at least one cutting member on a cylindrical outer periphery thereof, through-holes extending generally radially through the mantle; and an air distribution mechanism comprising:

a first air distribution part affixed to the mantle coaxially therein for rotation therewith, and a second air distribution part arranged inside said first air distribution part, wherein the first distribution part is rotatable relative to the second distribution part, wherein the first and second air distribution parts define air passages for communicating selective ones of the through-holes of the mantle with an air source in response to relative rotation between the first and second distribution parts.

* * * * *